US007726106B2

(12) United States Patent
Kelley et al.

(10) Patent No.: US 7,726,106 B2
(45) Date of Patent: Jun. 1, 2010

(54) CONTAINER HANDLING SYSTEM

(76) Inventors: Paul Kelley, 1180 Knights View Rd., Wrightsville, PA (US) 17368; Kent Goss, 8942 W. 311th St., Louisburg, KS (US) 66053; Philip Sheets, 668 Hampton at Waterford, York, PA (US) 17402; Ted Lyon, 218 W. Oak St., Shenandoah, PA (US) 17976; Charles A. Ryl-Kuchar, 14802 Cooper Penny Dr., Granger, IN (US) 46530

( * ) Notice: Subject to any disclaimer, the term of this patent is extended or adjusted under 35 U.S.C. 154(b) by 243 days.

(21) Appl. No.: 10/566,294

(22) PCT Filed: Jul. 30, 2004

(86) PCT No.: PCT/US2004/024581

§ 371 (c)(1),
(2), (4) Date: Sep. 5, 2006

(87) PCT Pub. No.: WO2005/012091

PCT Pub. Date: Feb. 10, 2005

(65) Prior Publication Data

US 2007/0051073 A1 Mar. 8, 2007

Related U.S. Application Data

(60) Provisional application No. 60/491,179, filed on Jul. 30, 2003, provisional application No. 60/551,771, filed on Mar. 11, 2004.

(51) Int. Cl.
*B65B 1/02* (2006.01)

(52) U.S. Cl. ..... 53/558; 53/471; 53/486; 53/290

(58) Field of Classification Search ..... 53/281, 53/289, 559, 558, 290, 471, 486, 453

See application file for complete search history.

(56) References Cited

U.S. PATENT DOCUMENTS

D110,624 S 7/1938 Mekeel, Jr.

(Continued)

FOREIGN PATENT DOCUMENTS

AU 2002257159 B2 4/2003

(Continued)

OTHER PUBLICATIONS

"Application and Development of PET Plastic Bottle," Publication of Tsinghad Tongfang Optical Disc Co. Ltd., Issue 4, 2000, p. 41. (No English language translation available).

(Continued)

*Primary Examiner*—Sameh H. Tawfik

(57) ABSTRACT

A system for processing a simplified plastic container (C) that is to be filled with a hot product includes the step of blow-molding parison to form a container body, where the container body has a neck, a base, a side surface relatively free of structural geometry that surrounds an interior of the container body and, prior to being filled with the hot product, a projection (12) extending from the container body. After the container body is filled with a hot product in a production line, the neck of the filled container body is capped with a cap and then, the container body is cooled. During the cooling operation, the hot product is contracted so that the projection extending from the container can be pushed (P) into the container body like a traditional push-up so that the resultant, filled and cooled container body is relatively free of structural geometry.

25 Claims, 14 Drawing Sheets

U.S. PATENT DOCUMENTS 2,378,324 A 6/1945 Ray et al.
2,960,248 A 11/1960 Kuhlman
3,043,461 A 7/1962 Glassco
3,325,031 A 6/1967 Singier
3,397,724 A 8/1968 Bolen et al.
3,409,167 A 11/1968 Blanchard
3,468,443 A 9/1969 Marcus
3,485,355 A 12/1969 Stewart
3,704,140 A 11/1972 Petit et al.
3,727,783 A 4/1973 Carmichael
3,918,920 A 11/1975 Barber
3,935,955 A 2/1976 Das
3,941,237 A 3/1976 MacGregor, Jr.
3,956,441 A * 5/1976 Uhlig ..... 264/530
4,036,926 A 7/1977 Chang
4,123,217 A 10/1978 Fischer et al.
4,125,632 A 11/1978 Vosti et al.
4,134,510 A 1/1979 Chang
4,170,622 A 10/1979 Uhlig
4,170,662 A 10/1979 Uhlig et al.
4,174,782 A 11/1979 Obsomer
4,231,483 A 11/1980 Dechenne et al.
4,301,933 A 11/1981 Yoshino et al.
4,318,489 A 3/1982 Snyder et al.
4,318,882 A 3/1982 Agrawal et al.
4,338,765 A * 7/1982 Ohmori et al. ..... 53/452
4,355,728 A 10/1982 Yoshino et al.
4,381,061 A 4/1983 Cerny et al.
D269,158 S 5/1983 Gaunt
4,386,701 A 6/1983 Galer
4,436,216 A 3/1984 Chang
4,450,878 A 5/1984 Takada et al.
4,610,366 A 9/1986 Estes et al.
4,628,669 A 12/1986 Herron et al.
4,642,968 A 2/1987 McHenry et al.
4,667,454 A 5/1987 McHenry et al.
4,684,025 A * 8/1987 Copland et al. ..... 206/484
D292,378 S 10/1987 Brandt et al.
4,773,458 A 9/1988 Touzani
4,785,949 A 11/1988 Krishnakumar et al.
4,785,950 A 11/1988 Miller et al.
4,807,424 A * 2/1989 Robinson et al. ..... 53/432
4,831,050 A 5/1989 Bettle
4,836,398 A 6/1989 Leftault, Jr. et al.
4,850,493 A 7/1989 Howard, Jr.
4,850,494 A 7/1989 Howard, Jr.
4,867,323 A 9/1989 Powers
4,880,129 A 11/1989 McHenry et al.
4,892,205 A 1/1990 Powers et al.
4,896,205 A 1/1990 Weber
4,967,538 A * 11/1990 Leftault et al. ..... 53/440
4,997,692 A 3/1991 Yoshino
5,005,716 A 4/1991 Eberle
5,014,868 A 5/1991 Wittig et al.
5,024,340 A 6/1991 Alberghini et al.
5,033,254 A * 7/1991 Zenger ..... 53/431
5,060,453 A 10/1991 Alberghini et al.
5,067,622 A 11/1991 Garver et al.
5,090,180 A * 2/1992 Sorensen ..... 53/471
5,092,474 A 3/1992 Leigner
5,133,468 A 7/1992 Brunson et al.
5,217,737 A 6/1993 Gygax et al.
5,234,126 A 8/1993 Jonas et al.
5,244,106 A 9/1993 Takacs
5,251,424 A 10/1993 Zenger et al.
5,255,889 A 10/1993 Collette et al.
5,261,544 A 11/1993 Weaver, Jr.
5,281,387 A 1/1994 Collette et al.
5,341,946 A 8/1994 Vailliencourt et al.
5,392,937 A 2/1995 Prevot et al.
5,411,699 A 5/1995 Collette et al.
5,472,181 A 12/1995 Lowell
RE35,140 E 1/1996 Powers, Jr.
5,484,052 A 1/1996 Pawloski et al.
5,503,283 A 4/1996 Semersky
5,598,941 A 2/1997 Semersky et al.
5,642,826 A 7/1997 Melrose
5,672,730 A 9/1997 Cottman
5,690,244 A 11/1997 Darr
5,713,480 A 2/1998 Petre et al.
5,730,914 A 3/1998 Ruppmann, Sr.
5,737,827 A 4/1998 Kuse et al.
5,780,130 A 7/1998 Hansen et al.
5,785,197 A 7/1998 Slat
5,829,614 A 11/1998 Collette et al.
5,887,739 A 3/1999 Prevot et al.
5,888,598 A 3/1999 Brewster et al.
5,897,090 A 4/1999 Smith et al.
5,906,286 A 5/1999 Matsuno et al.
5,908,128 A 6/1999 Krishnakumar et al.
D415,030 S 10/1999 Searle
5,976,653 A 11/1999 Collette et al.
RE36,639 E 4/2000 Okhai
6,065,624 A 5/2000 Steinke
6,213,325 B1 4/2001 Cheng et al.
6,228,317 B1 5/2001 Cargile
6,230,912 B1 5/2001 Rashid
6,277,321 B1 8/2001 Vailliencourt et al.
6,298,638 B1 10/2001 Bettle
6,375,025 B1 4/2002 Mooney
6,390,316 B1 5/2002 Mooney
6,413,466 B1 7/2002 Boyd et al.
6,439,413 B1 8/2002 Prevot et al.
6,467,639 B2 10/2002 Mooney
6,485,669 B1 11/2002 Boyd et al.
6,502,369 B1 1/2003 Andison et al.
6,514,451 B1 2/2003 Boyd et al.
6,585,124 B2 7/2003 Boyd et al.
6,595,380 B2 7/2003 Silvers
6,612,451 B2 9/2003 Tobias et al.
6,662,960 B2 12/2003 Hong et al.
6,749,780 B2 6/2004 Tobias
6,763,968 B1 7/2004 Boyd et al.
6,923,334 B2 8/2005 Melrose et al.
6,942,116 B2 9/2005 Lisch et al.
7,051,889 B2 5/2006 Boukobza
7,077,279 B2 7/2006 Melrose
7,137,520 B1 11/2006 Melrose
7,150,372 B2 12/2006 Lisch et al.
7,159,374 B2 1/2007 Abercrombie, III et al.
2001/0035391 A1 11/2001 Young et al.
2002/0074336 A1 6/2002 Silvers
2002/0096486 A1 7/2002 Iizuka et al.
2002/0153343 A1 10/2002 Tobias et al.
2003/0186006 A1 10/2003 Schmidt et al.
2003/0196926 A1 10/2003 Tobias et al.
2003/0217947 A1 11/2003 Ishikawa et al.
2004/0149677 A1 8/2004 Slat et al.
2004/0173565 A1 9/2004 Semersky et al.
2004/0211746 A1 10/2004 Trude
2006/0006133 A1 1/2006 Lisch et al.
2006/0138074 A1 6/2006 Melrose
2006/0231985 A1 10/2006 Kelley
2006/0243698 A1 11/2006 Melrose
2006/0255005 A1* 11/2006 Melrose et al. ..... 215/381
2006/0261031 A1 11/2006 Melrose
2007/0045312 A1 3/2007 Abercrombie, III et al.
2007/0051073 A1 3/2007 Kelley et al.
2007/0084821 A1 4/2007 Bysick et al.
2007/0181403 A1 8/2007 Sheets et al.
2007/0199915 A1 8/2007 Denner et al.
2007/0199916 A1 8/2007 Denner et al.
2007/0215571 A1 9/2007 Trude
2007/0235905 A1 10/2007 Trude et al.

2008/0047964 A1* 2/2008 Denner et al. ..... 220/624

FOREIGN PATENT DOCUMENTS

| | | | |
|---|---|---|---|
| CA | 2077717 | A1 | 3/1993 |
| DE | P2102319.8 | | 8/1972 |
| EP | 346518 | A1 | 12/1989 |
| EP | 0521642 | | 1/1993 |
| EP | 0 551 788 | A1 | 7/1993 |
| EP | 0 609 348 | B1 | 2/1997 |
| EP | 0916406 | A2 | 5/1999 |
| EP | 1 063 076 | A1 | 12/2000 |
| FR | 1571499 | | 6/1969 |
| GB | 1 113988 | | 5/1968 |
| GB | 2050919 | A | 1/1981 |
| JP | 48-31050 | | 9/1973 |
| JP | 49-28628 | | 7/1974 |
| JP | 54-72181 | A | 6/1979 |
| JP | 56-72730 | U | 6/1981 |
| JP | 57-37827 | U | 2/1982 |
| JP | 63-189224 | A | 8/1988 |
| JP | 3-43342 | A | 2/1991 |
| JP | 03-076625 | A | 4/1991 |
| JP | 5-193694 | | 8/1993 |
| JP | 07-300121 | A | 11/1995 |
| JP | 09-039934 | A | 2/1997 |
| JP | 09039934 | A | 10/1997 |
| JP | 10-230919 | A | 2/1998 |
| JP | 10-167226 | A | 6/1998 |
| JP | 10181734 | A | 7/1998 |
| JP | 2000229615 | | 8/2000 |
| JP | 2002-127237 | A | 5/2002 |
| JP | 2006-501109 | | 1/2006 |
| NZ | 506684 | | 9/2001 |
| NZ | 512423 | | 9/2001 |
| NZ | 521694 | | 10/2003 |
| WO | WO 93/09031 | A1 | 5/1993 |
| WO | WO 93/12975 | A1 | 7/1993 |
| WO | WO 97/34808 | A1 | 9/1997 |
| WO | WO 00/51895 | A1 | 9/2000 |
| WO | WO 01/40081 | A1 | 6/2001 |
| WO | WO 02/02418 | A1 | 1/2002 |
| WO | WO 02/18213 | A1 | 3/2002 |
| WO | WO 02/085755 | A1 | 10/2002 |
| WO | WO 2004/028910 | A1 | 4/2004 |
| WO | WO 2004/106176 | A2 | 9/2004 |
| WO | WO 2004/106175 | A1 | 12/2004 |
| WO | WO 2005/012091 | A2 | 2/2005 |
| WO | WO 2006/113428 | A3 | 10/2006 |

OTHER PUBLICATIONS

ISR for PCT/US2004/024581 dated Jul. 25, 2005.
IPRP (including Written Opinion) for PCT/US2004/024581 dated Jan. 30, 2006.
A certified copy of the filed wrapper and contents of U.S. Appl. No. 60/220,326, filed Jul. 24, 2000 dated Oct. 29, 2008.
Final Office Action for U.S. Appl. No. 10/558,284 dated Sep. 9, 2008.
Office Action for U.S. Appl. No. 10/558,284 dated Jan. 25, 2008.
Office Action for U.S. Appl. No. 10/851,083 dated Nov. 11, 2008.
Final Office Action for U.S. Appl. No. 10/851,083 dated Jun. 12, 2008.
Office Action for U.S. Appl. No. 10/851,083 dated Sep. 6, 2007.
International Search Report for PCT/US2005/008374 dated Aug. 2, 2005.
IPRP (including Written Opinion) for PCT/US2005/008374 dated Sep. 13, 2006.
International Search Report for PCT/US2004/016405 dated Feb. 15, 2005.
IPRP (including Written Opinion) for PCT/US2004/016405 dated Nov. 25, 2005.
Office Action for Application No. EP 06 750 165.0-2307 dated Nov. 24, 2008.
International Search Report for PCT/US2006/040361 dated Feb. 26, 2007.
IPRP (including Written Opinion) for PCT/US2006/040361 dated Apr. 16, 2008.
International Search Report for PCT/US2007/006318 dated Sep. 11, 2007.
IPRP (including Written Opinion) PCT/US2007/006318 dated Sep. 16, 2008.
International Search Report for PCT/US2006/014055 dated Dec. 7, 2006.
IPRP (including Written Opinion) PCT/US2006/014055 dated Oct. 16, 2007.
Manas Chanda & Salil K. Roy, Plastics Technology Handbook, Fourth Edition, 2007 CRC Press, Taylor & Francis Group, pp. 2-34-2-37.
Examination Report for New Zealand Application No. 550336 dated Mar. 26, 2009.
Examination Report for counterpart New Zealand Application No. 545528 dated Sep. 20, 2007.
Examination Report for counterpart New Zealand Application No. 569422 dated Sep. 29, 2009.
Office Action for U.S. Appl. No. 11/399,430 dated Sep. 4, 2009.
Office Action for U.S. Appl. No. 11/249,342 dated Jun. 10, 2009.
Office Action for Chinese Application No. 2006800380748 dated Jul. 10, 2009.
Examiner's Report for Australian Application No. 2006236674 dated Sep. 18, 2009.
Examiner's Report for Australian Application No. 2006236674 dated Nov. 6, 2009.
Office Action for Chinese Application No. 200680012360.7 dated Jul. 10, 2009.
Examination Report for New Zealand Application No. 563134 dated Aug. 3, 2009.
Office Action for U.S. Appl. No. 11/375,040 dated Dec. 1, 2009.
Office Action for European Application No. 07752979.0-2307 dated Aug. 21, 2009.
Official Notification for counterpart Japanese Application No. 2006-522084 dated May 19, 2009.
Examination Report for counterpart New Zealand Application No. 545528 dated Jul. 1, 2008.
Examination Report for counterpart New Zealand Application No. 569422 dated Jul. 1, 2008.

* cited by examiner

CONTAINER HANDLING SYSTEM

This application is a 371 of PCT international application no. PCT/US04/24581 filed on Jul. 30, 2004, which claims priority to Provisional application No. 60/491,179 filed Jul. 30, 2003 and Provisional application No. 60/551,771 filed Mar. 11, 2004. The contents of the aforementioned applications are hereby incorporated by reference in their entirety into this application.

BACKGROUND OF THE INVENTION

1. Field of the Invention

The present invention relates generally to a container handling system and a process for filling, capping and cooling hot-filled containers with a projection, and more particularly to a system and process for filling, capping and cooling hot-filled, blow-molded containers with a projection that can extend outside the container during the filling process and be inverted inside the container before the filled container is removed from a production line.

2. Related Art

Known blow-molded containers are usually made of plastic and employ flex panels that reinforce the integrity of the container while accommodating internal changes in pressures and volume in the container as a result of heating and cooling. This is especially true with hot-fillable containers, or containers in which hot products are injected during a filling process, capped and cooled to room temperature thereby allowing the filled product to cool to the ambient room temperature. Such containers are disclosed in U.S. Pat. Nos. 6,298,638, 6,439,413, and 6,467,639 assigned to Graham Packaging Company, all of which are incorporated by reference herein.

In order to obtain the necessary strength associated with glass containers, known hot-filled containers made out of plastic tend to be formed with protruding rib structures that surround panels forming the container. While the protruding rib structures improve the strength of the container that is blow-molded out of plastic, the resultant, lightweight, blow-molded containers with panels and protruding rib structure detract from the desired smooth, sleek look of a glass container. Accordingly, a hot-fillable, blow-molded container and process of filing, capping and cooling the same is needed that more closely simulates a glass container and achieves the smooth outward appearance associated with glass containers.

In addition to having protruding rib structures for strength, known hot-filled plastic containers tend to have rectangular panels for vacuum compensation. For example, conventional hot-fill containers, depending upon the size, may have 6 vacuum or flex panels to take up the resultant vacuum after cooling the hot-filled product with rigid, structural columns or ribs between each vacuum panel. It is known in the art to cover the protruding rib structures and panels with a paper label to improve the aesthetics or overall appearance of the plastic container. Consequently, in order to provide support for the label, the panels of such containers are provided with additional protruding structures. Thus, hot-filled containers are provided with more recesses and corners from which hot-filled solid products are not easily removed. Or, if the hot-filled product is subsequently chilled by placing the container in ice, the label covering the panels with protruding structures traps water inside the recessed panels resulting in spillage of the water after the container is removed from ice. Accordingly, a hot-filled, plastic container with a smoother side surface that is relatively or completely free of structural geometry is desired to overcome the shortcomings of the prior art.

BRIEF SUMMARY OF THE INVENTION

A three stage system utilizes a simplified, blow-molded container that retains its structural integrity after being hot filled and cooled through conventional food or beverage systems. That is, a simplified container according to the invention is a container with at least a portion of the container side walls being relatively smooth that can be filled with a hot product, such as a liquid or a partly solid product, and retain the requisite strength so that a number of containers can be stacked on top of one another with the resultant stack being sturdy. The relatively smooth surface is relatively or completely free of structural geometry, such as the structural ribs, riblets, or vacuum panels. In addition, the simplified, blow-molded container still retains the features of vacuum packaging and the ability to accommodate internal changes in pressure and volume as a result of heating and cooling. That is, the simplified container may employ a single main invertible projection by itself to take up the vacuum; or, the simplified container may have a few main projections that take up the vacuum while still providing a substantial portion of the container to be relatively smooth for label placement, for example. Alternatively, depending upon the size of the container, a mini vacuum panel to supplement the main invertible projection may be used to complete the removal of the resultant vacuum and finish the look of the cooled container. Unlike conventional containers, structural ribs between vacuum panels are not necessary in a simplified container where a substantial portion of the container body is relatively smooth.

Initially, a container is blow-molded with an approximately polygonal, circular or oval projection extending, for example, from a base of the container. The approximately polygonal, circular or oval projection may project from the shoulders of the container, or from another area of the container. If the projection extends from the base of the container, before the container exits the blow-molding operation, the projection may be inverted inside the container so that the base surface of the blow-molded container is relatively flat so that the container can be easily conveyed on a table top, without toppling.

In the next stage, the blow-molded container may be picked-up by a robotic arm or the like and placed into a production line conveyor where it is supported by its neck. A mechanical operation causes a rod to be inserted in the neck of the container and pushes the inverted projection outside the container to provide for the increased volume necessary to receive a hot-filled product, as well as accommodating variations in pressure due to temperature changes during cooling. Alternatively, compressed air or other pressure may be used to push the inverted projection outside of the container. With the projection extending outside the container, the container is filled with a hot product, capped and moved to the cooling operation. Since the container is supported by its neck during the filling and capping operations, the process according to the invention provides maximum control of the containers while being filled and capped.

The third stage of the operation may divide the filled and capped containers into different lanes and then the containers may be positioned in a rack or basket before entering the cooler for the cooling of the hot-filled product. It is envisioned that a robotic arm may lift the filled and capped container with the projection extending from the container into a rack or basket. If the projection extends from the base of the container, the basket or rack is provided with an opening for receiving the projection and or enabling the container to stand upright. The container-filled basket or rack is then conveyed through a cooling system to bring the temperature of the hot-filled container to room temperature.

As the hot-filled product in the container is cooled to room temperature, the container becomes distorted as a vacuum is created in an area where the once hot product filled a portion of the container. Thus, there is no longer a need for the increased volume obtained by the projection extending from the container. In addition, the cooled, distorted container needs to be reformed to the aesthetic original container shape. Accordingly, it is now possible to return the containers to the desired aesthetic shape obtained after the cool-down contraction of the product by an activator that pushes against the extending projections while the containers are held in place thereby pushing the projection inside the container in an inverted state. This inverted state may be the same inverted state achieved before exiting the blow-molding operation.

The activator, according to one embodiment of the invention, may be a relatively flat piece of material with approximately polygonal or circular projections extending therefrom at intervals corresponding to openings of a basket that receive the container projections. The activator may be a panel that can invert projections of a single row of containers in the basket. Or, the activator may have several rows of polygonal or circular projections so that an entire basket of containers with projections can be inverted with one upward motion of the activator. While the preceding embodiment describes an activator for inverting projections extending from the base of a container, other activators for inverting projections extending from the shoulders or other areas of the container are envisioned. The activator panel can be made out of heavy plastic, metal or wood. The action of inverting the extending projection absorbs the space of the vacuum created by the cooling operation and provides all the vacuum compensation necessary for the cooled, product-filled container.

This invention satisfies a long felt need for a plastic, blow-molded container having a smooth outward appearance similar to that of a heavier glass container.

A system for manufacturing a simplified plastic container that is to be filled with a hot product, comprising the steps of blow-molding parison to form a container body, the container body having a neck, a base, a smooth side surface surrounding an interior of the container body and a projection extending from the container; filling the container body with the hot product in a production line; capping the neck of the filled container body with a cap in the next operation of the production line; cooling the container body filled with the hot product; and pushing the projection extending from the cooled container body into the interior of the container body so that the resultant, filled and cooled container body is relatively flat. If the projection extends from a base of the container, this inversion permits conveying of the container body on its base.

Further objectives and advantages, as well as the structure and function of preferred embodiments will become apparent from a consideration of the description, drawings, and examples.

BRIEF DESCRIPTION OF THE DRAWINGS

The foregoing and other features and advantages of the invention will be apparent from the following, more particular description of a preferred embodiment of the invention, as illustrated in the accompanying drawings wherein like reference numbers generally indicate identical, functionally similar, and/or structurally similar elements.

DETAILED DESCRIPTION OF THE INVENTION

Embodiments of the invention are discussed in detail below. In describing embodiments, specific terminology is employed for the sake of clarity. However, the invention is not intended to be limited to the specific terminology so selected. While specific exemplary embodiments are discussed, it should be understood that this is done for illustration purposes only. A person skilled in the relevant art will recognize that other components and configurations can be used without parting from the spirit and scope of the invention. All references cited herein are incorporated by reference as if each had been individually incorporated.

Figure 1B:
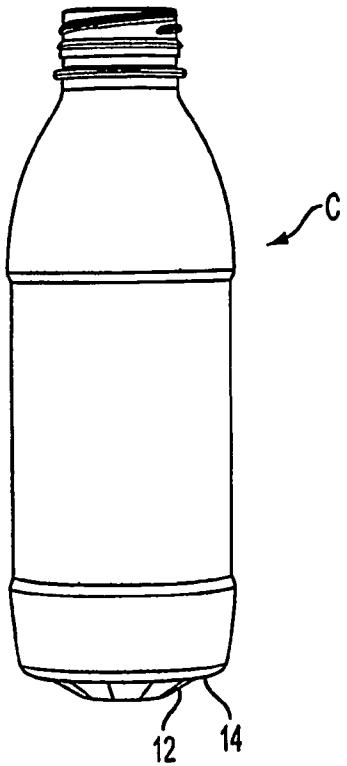
FIG. 1B illustrates an embodiment of a plastic, blow-molded container with a smooth surface according to the invention.
Figure 1A:
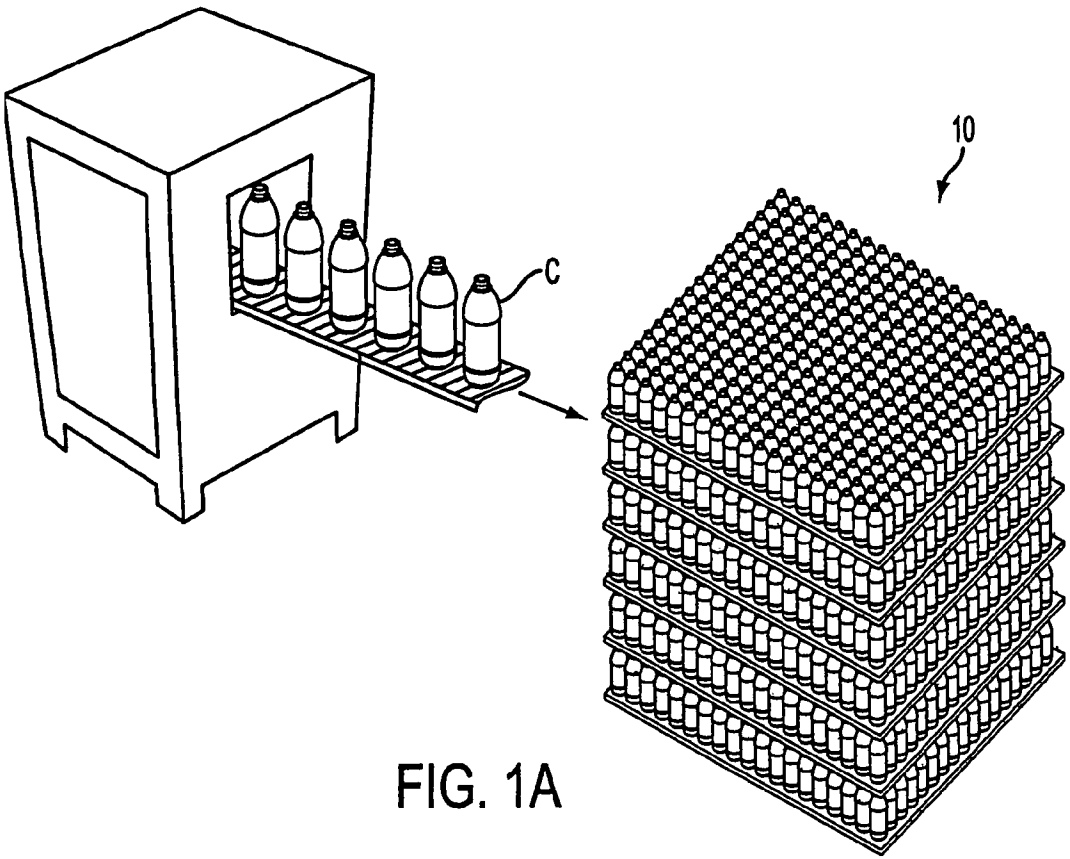
FIG. 1A schematically depicts containers according to the invention leaving the blow-molding operation.

As shown schematically in FIG. 1A, containers C formed in a blow-molding or forming operation may exit the blow-molding operation with a base designed so that the container can stand on its own. That is, a container with a relatively smooth side surrounding its interior may be blow-molded with a projection extending from the base of the smooth sided container, and before the blow-molded container leaves the blow-molding operation, the projection of the base may be inverted inside the interior of the container so that the resultant base surface of the container can easily be conveyed in a table top manner. As shown in FIG. 1, the blow-molded containers may be placed in shipping containers 10 or on pallets with, for example, 24 columns and 20 rows so that each rack carries 480 bottles or containers. The inverted blow-molded projection can be designed so that the finish or neck area of a container can securely rest within the inverted blow-molded projection. As a result, the pallets holding the containers can be stacked for easier transportation to an operation that fills, caps and then cools the filled containers.

As shown in FIG. 1B, the blow-molded containers may be smooth cylinders on the outside without the vacuum compression panels previously considered necessary on the side of the container, which detracted from the sleek appearance of the container and provided recesses for gathering product or ice water. These blow-molded containers are preferably made of plastic, such as a thermoplastic polyester resin, for example PET (polyethylene terephthalate) or polyolefins, such as PP and PE. Each container is blow-molded and formed with an approximately polygonal, circular or oval projection 12 that extends from its base during the initial blow-mold operation. In the exemplary embodiment, the relatively smooth side surface of the container may taper slightly in the mid-section of the container to provide an area to place a label. In another embodiment of such a blow-molded container, the smooth side surface may not be formed with the slight depressed area if the label is printed on the container, for example. Alternatively, the relatively smooth surface may have ornamental features (e.g., textures).

In the case of larger containers (e.g., 64 oz.), a container may be formed with a grip panel on a portion of the cylindrical body of the container. Thus, Applicants envision simplified containers where a substantial portion of the cylindrical body is relatively or completely free of structural geometry. An invertible projection may be formed at the base of the container. The invertible projection may take up most of the vacuum bringing the cooled hot-filled container to its aesthetic appearance. It is envisioned that mini or supplemental vacuum panels may be necessary to complete the removal of the vacuum in larger containers. These mini or supplemental vacuum panels may be incorporated in the grip panel or at an area that does not interfere with the positioning of a label.

Grip panels are disclosed, for example, in U.S. Pat. Nos. 6,375,025; 5,392,937; 6,390,316; and 5,598,941. Many of the grip panels disclosed in the prior art may also serve as vacuum relief or flex panels. Utilizing the present invention, it is not necessary for the grip panel to act as a vacuum relief panel and the design may therefore be simplified. That is, the ribbed structure associated with the flex panel may not be necessary, or label panel support ribs may be reduced or eliminated. Persons of ordinary skill in the art will be able to modify or simplify known grip panels for use with the present invention.

The base of a blow-molded container, according to one embodiment of the invention, has an inversion or standing ring 14 adjacent a tapered area of the smooth side surface and inside the inversion ring is a substantially smooth projection 12 that extends approximately from a center of the base. The size and shape of the projection 12 depends upon the size and shape of the container that is formed during the blow-molding operation, as well as the contraction properties of the contained product. Prior to leaving the blow-molding operation, the projection may be forced inside the container to provide a relatively flat surface at the container's base, or a stable base for the container. This inversion of the projection 12 extending from the base of the blow-molded container may be accomplished by pneumatic or mechanical means.

Figure 7:
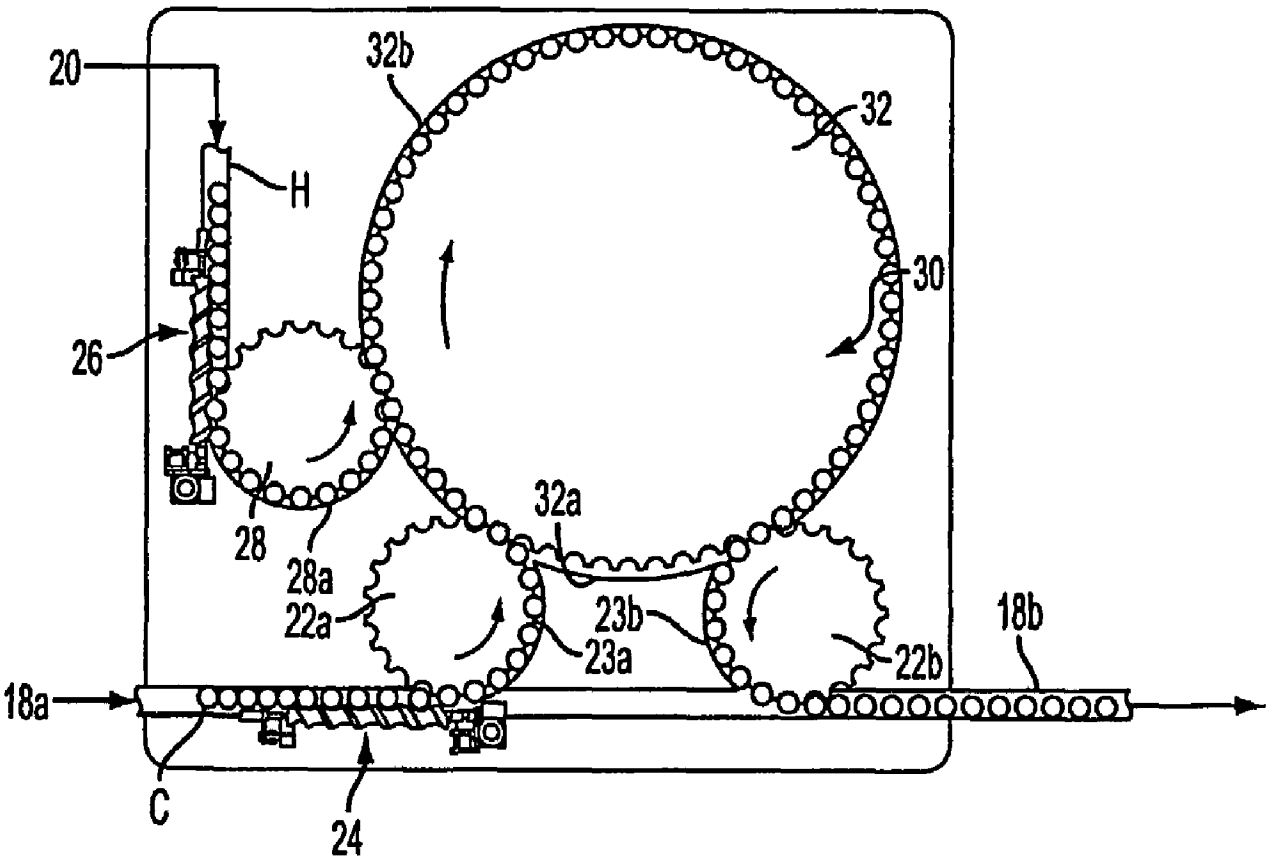
FIG. 7 is a schematic plan view of an exemplary handling system that combines single containers with a container holding device according to the invention.

In this manner, as best seen in FIG. 7, containers C can be conveyed singularly to a combining system that combines container holding devices and containers. The combining system of FIG. 7 includes a container in-feed 18*a* and a container holding device in-feed 20. As will be more fully described below, this system may be one way to stabilize containers with projected bottom portions that are unable to be supported by their bottom surfaces alone. Container in-feed 18*a* includes a feed scroll assembly 24, which feeds and spaces the containers at the appropriate spacing for merging containers C into a feed-in wheel 22*a*. Wheel 22*a* comprises a generally star-shaped wheel, which feeds the containers to a main turret system 30 and includes a stationary or fixed plate 23*a* that supports the respective containers while containers C are fed to turret system 30, where the containers are matched up with a container holding device H and then deactivated to have a projecting bottom portion.

Similarly, container holding devices H are fed in and spaced by a second feed scroll 26, which feeds in and spaces container holding devices H to match the spacing on a second feed-in wheel 28, which also comprises a generally star-shaped wheel. Feed-in wheel 28 similarly includes a fixed plate 28*a* for supporting container holding devices H while they are fed into turret system 30. Container holding devices H are fed into main turret system 30 where containers C are placed in container holding devices H, with holding devices H providing a stable bottom surface for processing the containers. In the illustrated embodiment, main turret system 30 rotates in a clock-wise direction to align the respective containers over the container holding devices fed in by star wheel 28. However, it should be understood that the direction of rotation may be changed. Wheels 22*a* and 28 are driven by a motor 29 (FIG. 8), which is drivingly coupled, for example, by a belt or chain or the like, to gears or sheaves mounted on the respective shafts of wheels 22*a* and 28.

Container holding devices H comprise disc-shaped members with a first recess with an upwardly facing opening for receiving the lower end of a container and a second recess with downwardly facing opening, which extends upwardly from the downwardly facing side of the disc-shaped member through to the first recess to form a transverse passage through the disc-shaped member. The second recess is smaller in diameter than the first so as to form a shelf in the disc-shaped member on which at least the perimeter of the container can rest. As noted above, when a container is deactivated, its vacuum panels will be extended or projecting from the bottom surface. The extended or projecting portion is accommodated by the second recess. In addition, the containers can then be activated through the transverse passage formed by the second recess, as will be appreciated more fully in reference to FIGS. 5A-C and 12-13 described below.

In order to provide extra volume and accomodation of pressure changes needed when the containers are filled with a hot product, such as a hot liquid or a partly solid product, the inverted projection of the blow-molded containers should be pushed back out of the container (deactivated). For example, a mechanical operation employing a rod that enters the neck of the blow-molded container and pushes against the inverted projection of the blow-molded container causing the inverted projection to move out and project from the bottom of the base, as shown in FIGS. 1B, 5C and 12-13. Alternatively, other methods of deploying the inverted projection disposed inside a blow-molded container, such as injecting pressurized air into the blow-molded container, may be used to force the inverted projection outside of the container. Thus, in this embodiment, the blow-molded projection is initially inverted inside the container and then, a repositioning operation pushes the inverted projection so that it projects out of the container.

Figure 8:
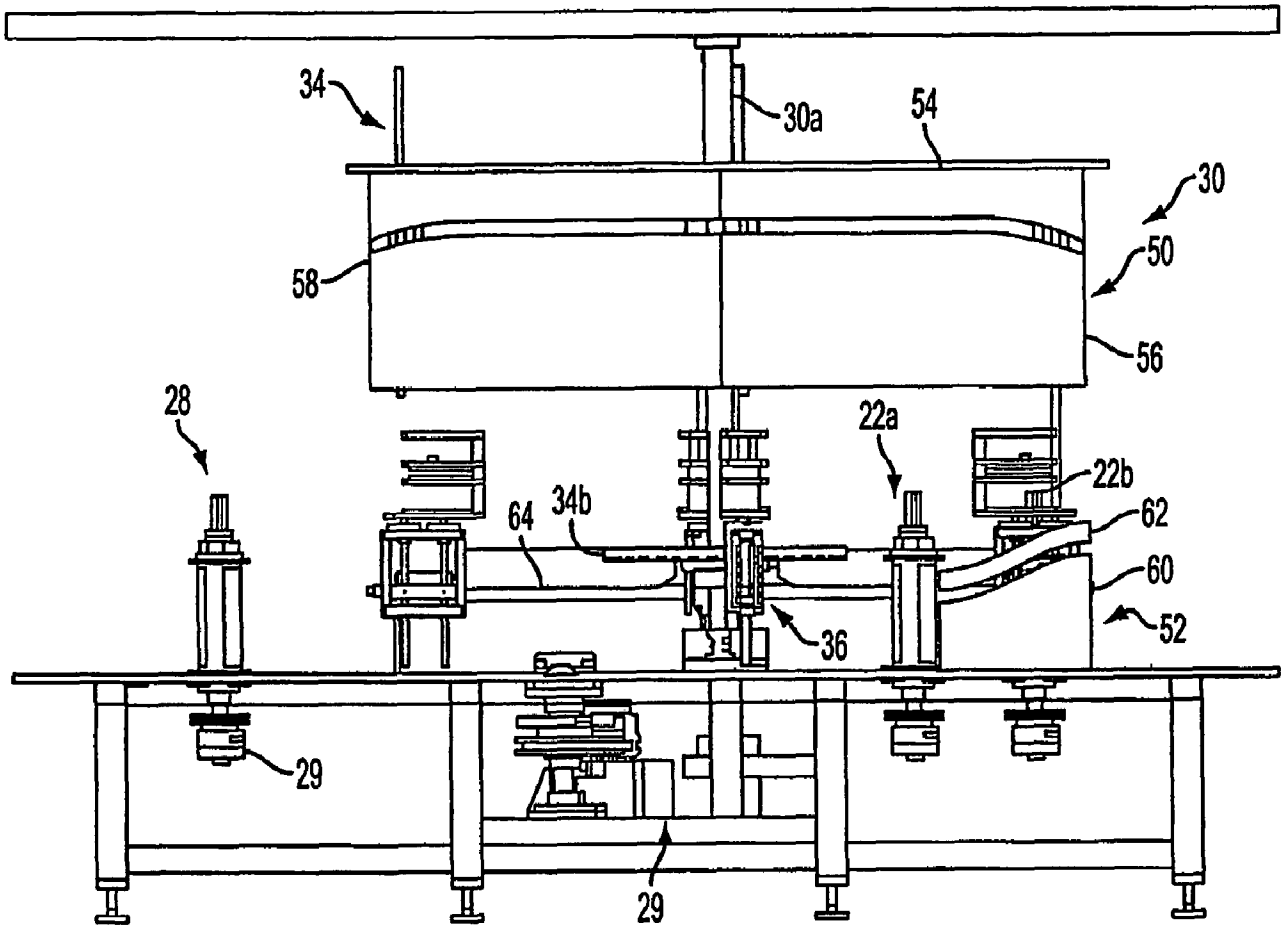
FIG. 8 is a front side elevation view of the handling system of FIG. 7.
Figure 9:
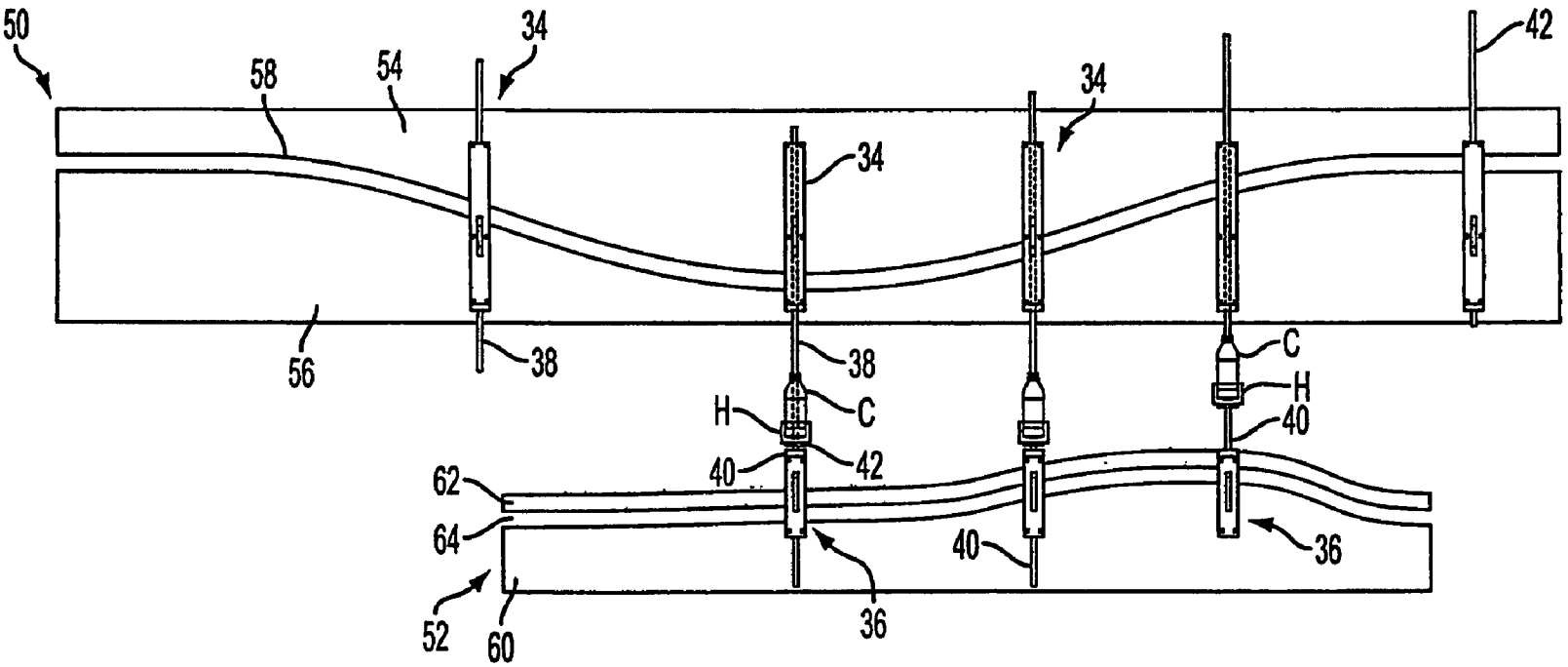
FIG. 9 is an unfolded elevation view of a section of the combining portion of the handling system of FIG. 8 illustrating the movement of the actuators.

Referring to FIG. 8, main turret system 30 includes a central shaft 30*a*, which supports a container carrier wheel 32, a plurality of radially spaced container actuator assemblies 34 and, further, a plurality of radially spaced container holder actuator assemblies 36 (FIG. 9). Actuator assemblies 34 deactivate the containers (extend the inverted projection outside the bottom surface of the container), while actuator assemblies 36 support the container holding devices and containers. Shaft 30*a* is also driven by motor 29, which is coupled to a gear or sheave mounted to shaft 30*a* by a belt or chain or the like. In addition, main turret system 30 includes a fixed plate 32*a* for supporting the containers as they are fed into container carrier wheel 32. However, fixed plate 32*a* terminates adjacent the feed-in point of the container holding devices so that the containers can be placed or dropped into the container holding devices under the force of gravity, for example. Container holding devices H are then supported on a rotating plate 32*b*, which rotates and conveys container holding devices H to discharge wheel 22*b*, which thereafter feeds the container holding devices and containers to a conveyor 18*b*, which conveys the container holding devices and containers to a filling system. Rotating plate 32*b* includes openings or is perforated so that the extendable rods of the actuator assemblies 36, which rotate with the rotating plate, may extend through the rotating plate to raise the container holding devices and containers and feed the container holding devices and containers to a fixed plate or platform 23*b* for feeding to discharge wheel 22*b*.

As best seen in FIG. 9, each actuator assembly 34, 36 is positioned to align with a respective container C and container holding device H. Each actuator assembly 34 includes an extendable rod 38 for deactivating containers C, as will be described below. Each actuator assembly 36 also includes an extendable rod 40 and a pusher member 42, which supports a container holding device, while a container C is dropped into the container holding device H and, further supports the container holding device H while the container is deactivated by extendable rod 38. To deactivate a container, actuator assembly 34 is actuated to extend its extendable rod 38 so that it extends into the container C and applies a downward force onto the invertible projection (12) of the container to thereby move the projection to an extended position to increase the volume of container C for the hot-filling and post-cooling process that follows (FIG. 1B). After rod 38 has fully extended the invertible projection of a container, rod 38 is retracted so that the container holding device and container may be conveyed for further processing.

Again as best seen in FIG. 9, while rod 38 is retracted, extendable rod 40 of actuator 36 is further extended to raise the container holding device and container to an elevation for placement on fixed plate or platform 23*b* of discharge wheel 22*b*. Wheel 22*b* feeds the container holding device and container to an adjacent conveyor 18*b*, which conveys the container holding device and container to filling portion 16 of the container processing system. Discharge wheel 22*b* is similar driven by motor 29, which is coupled to a gear or sheave mounted on its respective shaft.

Referring again to FIGS. 8 and 9, main turret assembly 30 includes an upper cam assembly 50 and a lower cam assembly 52. Cam assemblies 50 and 52 comprise annular cam plates that encircle shaft 30*a* and actuator assemblies 34 and 36. The cam plates provide cam surfaces to actuate the actuator assemblies, as will be more fully described below. Upper cam assembly 50 includes upper cam plate 54 and a lower cam plate 56, which define there between a cam surface or groove 58 for guiding the respective extendable rods 38 of actuator assemblies 34. Similarly, lower cam assembly 52 includes a lower cam plate 60 and an upper cam plate 62 which define there between a cam surface or groove 64 for guiding extendable rods 40 of actuator assemblies 36. Mounted to extendable rod 38 may be a guide member or cam follower, which engages cam groove or surface 58 of upper cam assembly 50. As noted previously, actuator assemblies 34 are mounted in a radial arrangement on main turret system 30 and, further, are rotatably mounted such that actuator assemblies 34 rotate with shaft 30*a* and container holder wheel 32. In addition, actuator assemblies 34 may rotate in a manner to be synchronized with the in-feed of containers C. As each of the respective actuator assemblies 34 is rotated about main turret system 30 with a respective container, the cam follower is guided by groove 58 of cam assembly 50, thereby raising and lowering extendable member 38 to deactivate the containers, as previously noted, after the containers are loaded into the container holding devices.

If the container holding devices are not used, the containers according to the invention may be supported at the neck of each container during the filling and capping operations to provide maximum control of the container processes. This may be achieved by rails R, which support the neck of the container, and a traditional cleat and chain drive, or any other known like-conveying modes for moving the containers along the rails R of the production line. The extendable projection 12 may be positioned outside the container C by an actuator as described above.

Figure 2:
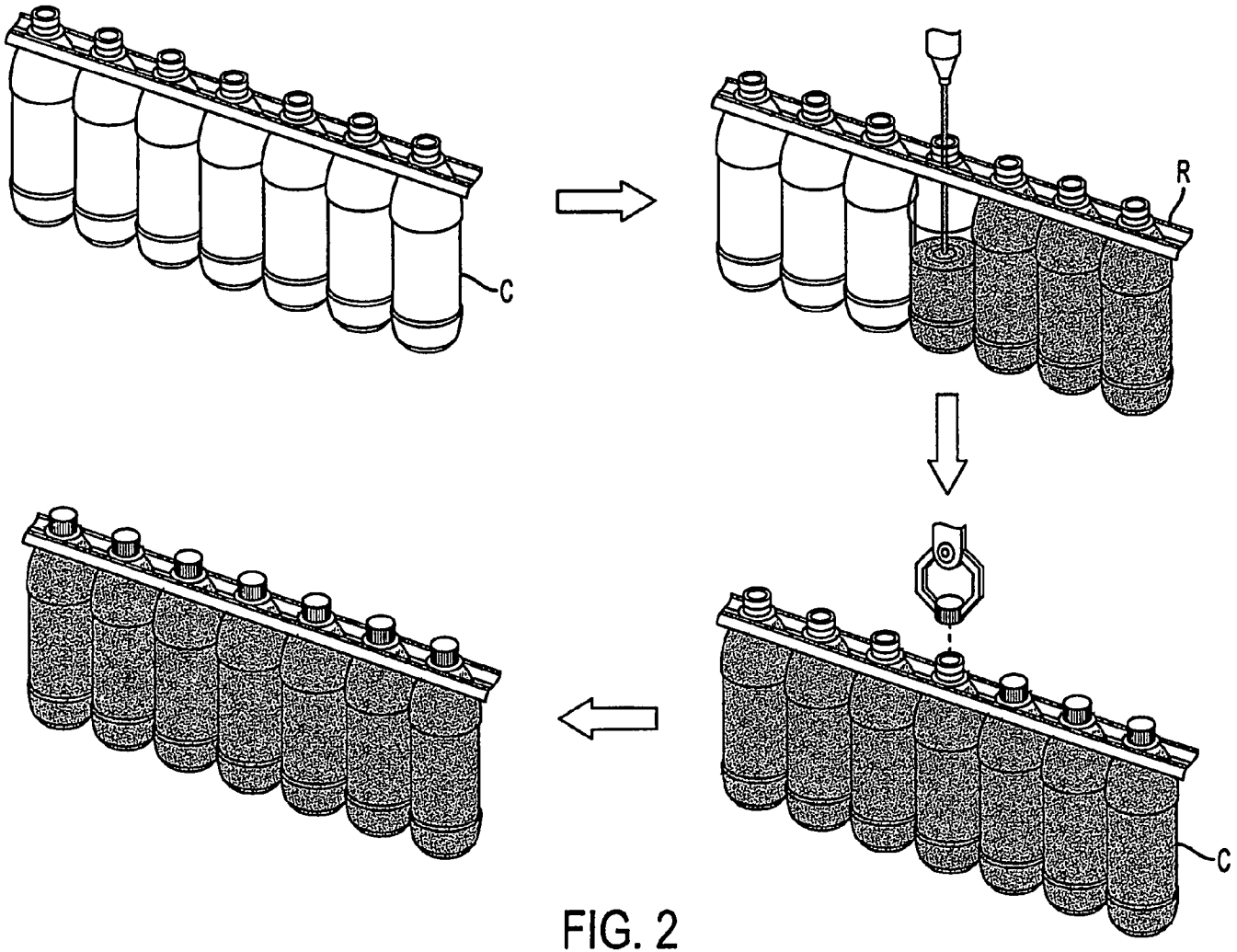
FIG. 2 schematically depicts containers being filled and capped.

The process of repositioning the projection outside of the container preferably should occur right before the filling of the hot product into the container. According to one embodiment of the invention, the neck of a container would be sufficiently supported by rails so that the repositioning operation could force or pop the inverted base outside of the container without causing the container to fall off the rail conveyor system. In some instances, it may not be necessary to invert the projection prior to leaving the blow-molding operation and these containers are moved directly to a filling station. The container with an extended projection, still supported by its neck, may be moved by a traditional neck rail drive to the filling and capping operations, as schematically shown in FIG. 2.

Figure 3B:
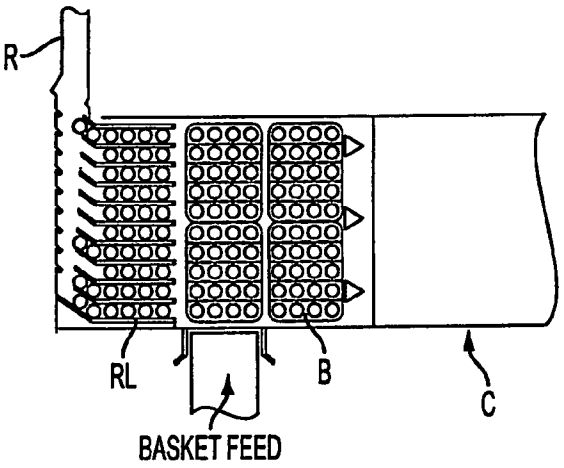
FIGS. 3A and B depict exemplary channeling of containers into baskets or racks according to the present invention for the cooling operation.
Figure 3A:
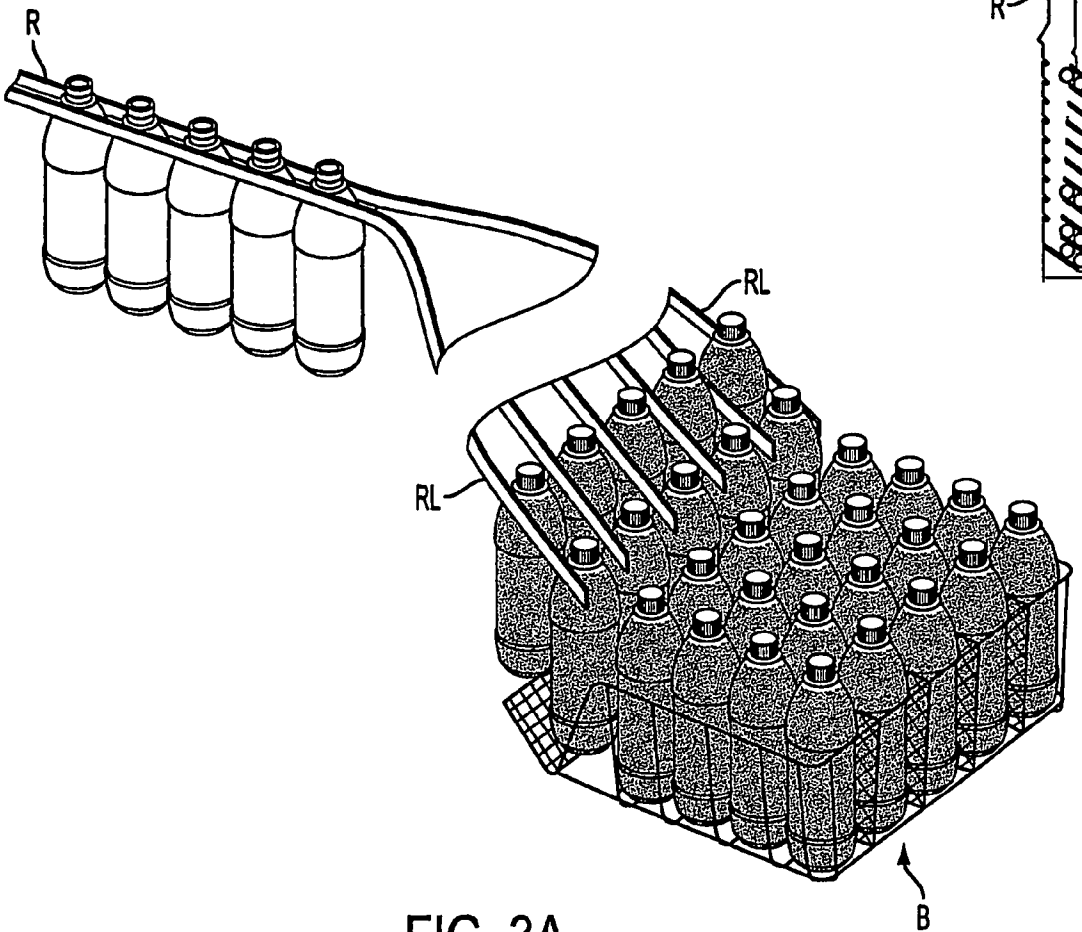

As shown in FIG. 3A, the system for conveying the filled containers may include dividing the single filling and capping rail R into a plurality of rail lanes RL that feed into a shuttle basket B or rack system. The continuous batch mode handling of the containers into the cooling baskets or racks provides total control of the containers/package throughout the cooling cycle. As shown in FIG. 3B, baskets or racks are mechanically fed into a lane where the basket or rack receives hot-filled containers with the extending projections from each of the plurality of rail lanes, until the basket is full. After the basket or rack is full of filled containers, it is moved for example, perpendicularly away from the direction of basket or rack feed toward a cooler. The shuttle basket or rack system may be driven through a traditional container cooler via a cleat and chain drive, for example.

In one embodiment, the basket may have a gate, which swings down from its upward position in order to allow containers C with the extending projection 12 to enter the basket. In that the hot-filled containers have projections extending from their base, the rail lanes and basket may be controlled in a sequence to fill the basket or rack with containers. For example, the basket or rack would have a plurality of openings for receiving respective projections of the hot-filled containers. Either robotic arms and/or the rail lanes would lift a row of hot-filled containers with extending projections over the gate and into respective openings of the basket. The basket would move away from its initial fed position exposing another row of openings for receiving hot-filled containers and then that row would be filled with the containers with the extending projections. This process would continue so that the entire basket could receive hot-filled containers.

The handling of the filled and capped containers with extending projections would also be sequenced so that there would be room underneath the rail lanes to feed the basket or rail. Thus, the basket could be positioned initially so that a container fed down each rail lane could be lifted into a respective opening of the basket. The basket would move to the left, as shown in FIG. 3B, and then the next row of containers would be fed down each rail lane and then lifted into the second row openings of the basket or rail. Alternatively, the basket or racks could be fed into their position and a robotic arm of the rail lanes could pick up each container and place the same in a respective opening of the basket or rack.

Figure 4:
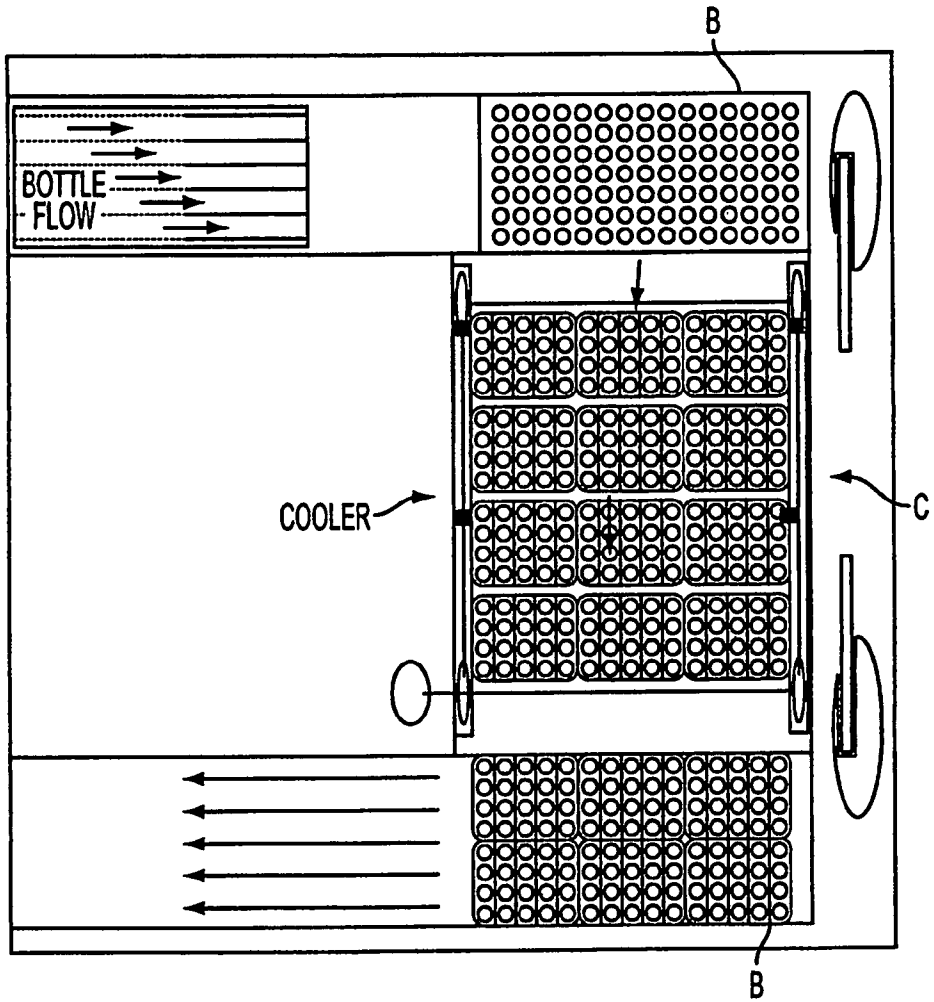
FIG. 4 depicts an exemplary flow of racked containers in a cooler according to the present invention.

After the basket is full of hot-filled containers, the gate would swing upwards and lock onto the side of the basket and then the basket would move toward the cooler C. Thus, according to the invention, the handling system provides lane control to align the containers before they are placed in the basket or rack system. FIG. 4 illustrates how a shuttle basket B or rack system may travel through a traditional cooler, which may have ambient air or coolant blowing against the hot-filled containers to cool their contents to room temperature.

After the containers and their contents have been cooled during the cooling operation, the cooled product has contracted and thus an extra amount of volume exists in these cooled containers. However, the cooling operation also induces a vacuum in each container which distorts each container thereby lessening the amount of volume in the container. Since the projection extending from the base of the container is no longer necessary and a relatively flat base surface is desired, each shuttle basket or rack enters an activation operation, which reforms the containers from the induced vacuum caused by the cooled down contraction of the product within the containers to aesthetic containers. The basket or racks provide location and control of the containers during the activation step at the end of the cooling cycle.

Figure 5A:
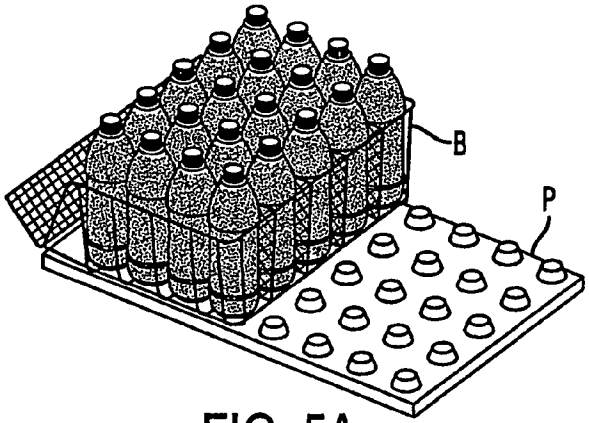
FIGS. 5A-C schematically illustrate one embodiment of an activation operation according to the invention.
Figure 5B:
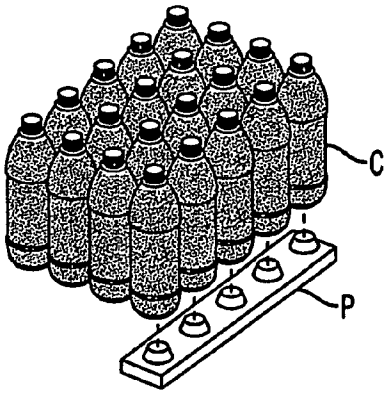
Figure 5C:
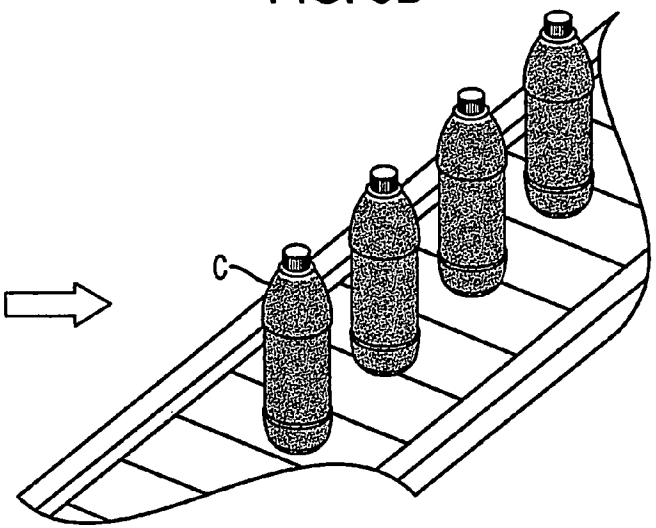
Figure 5C:
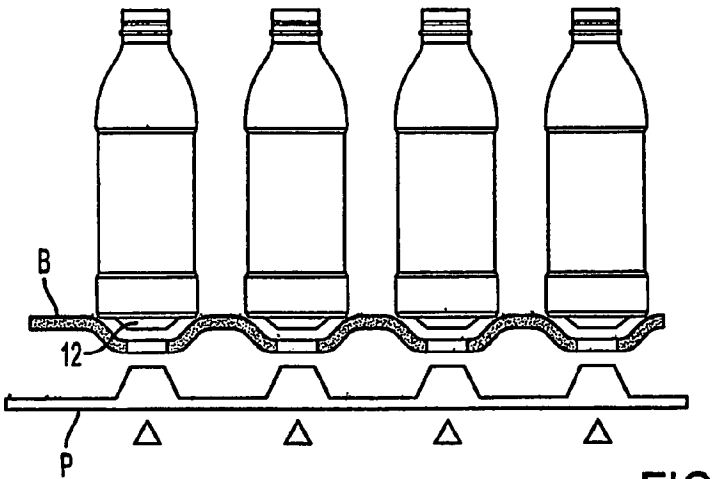

As schematically shown in FIGS. 5A-C, the activation operation is achieved by placing a panel P with a number of projections corresponding to the projections extending from the containers underneath a container-filled basket B or rack. The panel and projections may rest underneath a single row or column of the containers in the basket or rack. Or, the panel and associated projections may be larger extending over two or more row or columns. An arm or cover (not shown) is placed over the containers to be activated. Then, the panel is moved upward towards the projections with sufficient force to push the projections back to their inverted position inside a respective container, like a traditional push-up. Thus, the extending projection is moved back inside the container body or re-inverted inside the container. The arm or cover placed over the containers holds the containers in place when the force of the activator panel is applied against the containers. It is envisioned that a panel the size of the basket or rack and with respective projections that extend to each of the openings of the basket or rack could invert the projecting base of the container inside each opening in the basket or rack, if the force applied to the panel is sufficient to pop the projecting bases back into the container.

Figure 6:
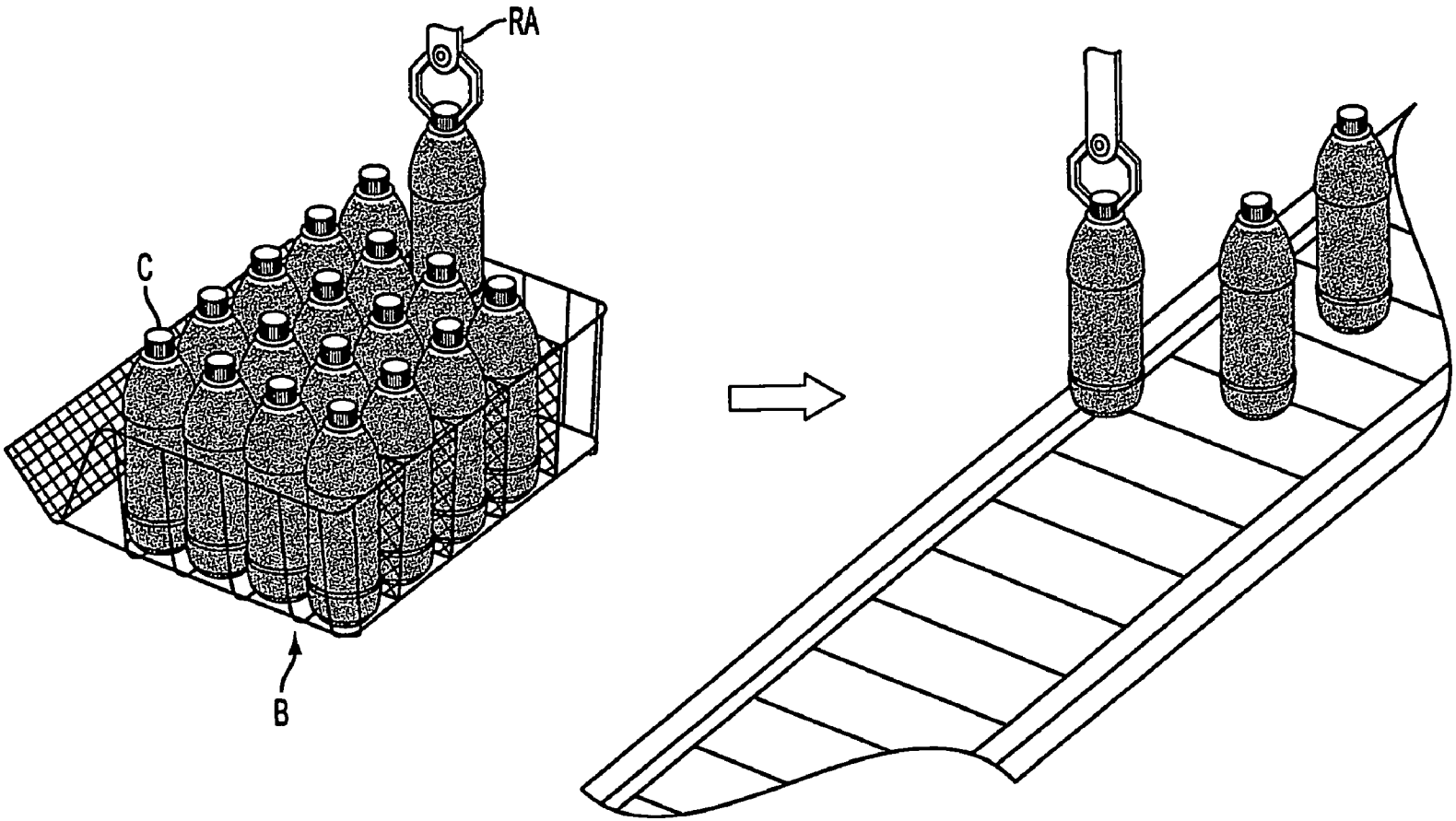
FIG. 6 schematically depicts an exemplary embodiment of containers exiting the cooling operation, after the activation operation according to the present invention.

In an exemplary embodiment, the activation step would occur at the end of the cooling cycle and would absorb or counter the vacuum created during the cooling of the hot product. Once the base projections have been re-inverted so that each base surface is relatively flat, the containers may be unloaded from the basket or racks that shuttle the containers through the cooler. As schematically shown in FIG. 6, at the cooling exit, a robotic arm RA may lift the containers at their capped neck vertically upwards and then out of the basket B or rack. The containers with the inverted bases would then be released from the robotic arm and sent down another conveying line like a normally filled bottle or container. The conveying line could be an in-line rail belt or could be an in-line conveying system using air to control the movement of the containers. The conveying line may feed the containers to a labeling operation and then to a packaging operation where the containers are loaded into cases for shipping to a grocery store or the like.

In an alternative operation, it is envisioned that containers would continue along the production line from the filling station, the capping station and through a cooling station. That is, instead of queuing up the containers for placement in a basket or rack for the cooling operation, each container would move along a production conveyor line. After each container passed through a cooling station, an activator would force the projecting base into the interior of the container. In a similar alternative embodiment where containers are individually passed through the cooling station, the cooled containers are then re-inverted as previously described. Then, the activated containers could be placed in conventional baskets or racks.

Figure 10:
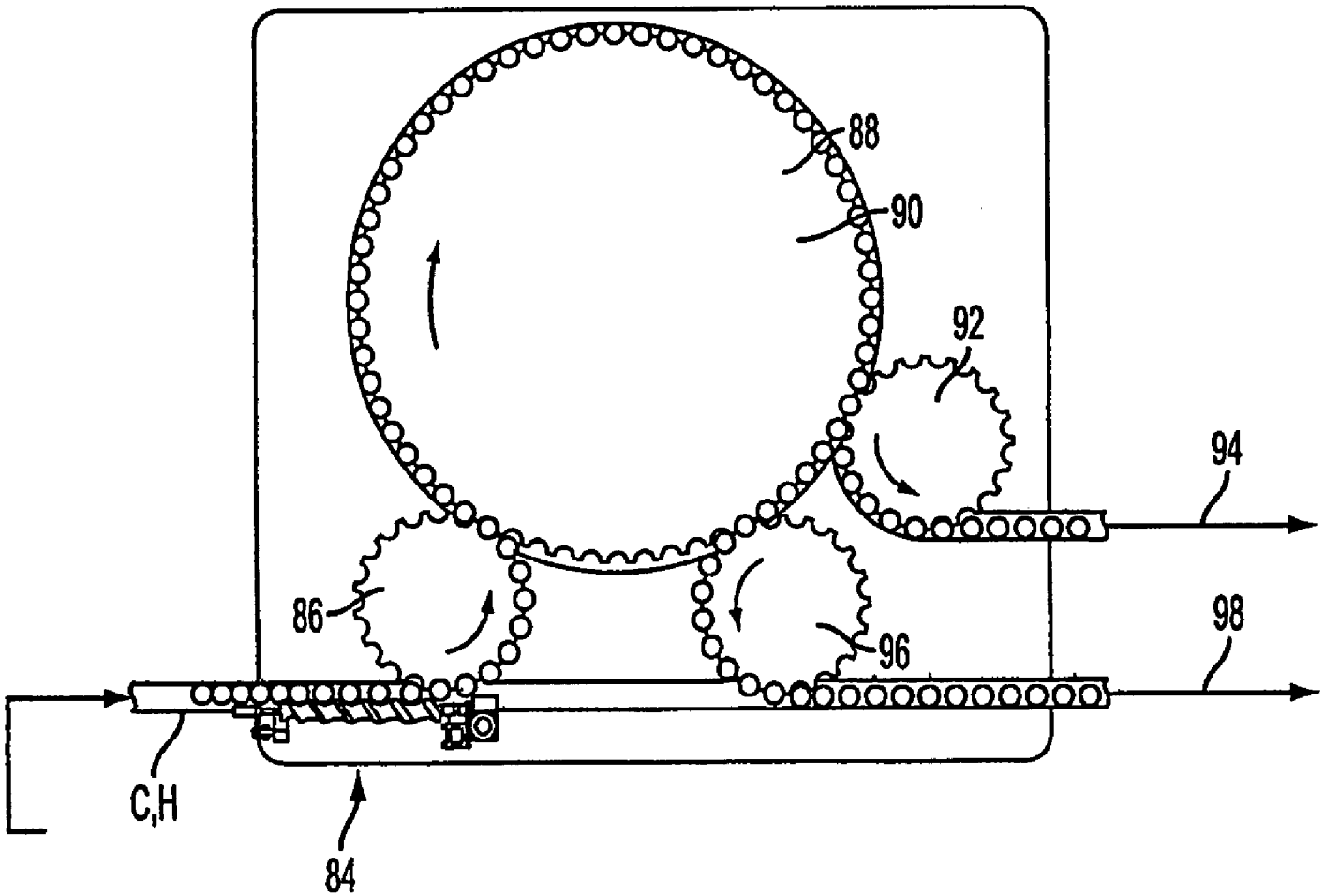
FIG. 10 is a schematic plan view of a second embodiment of an activation portion of the handling system of the present invention.
Figure 11:
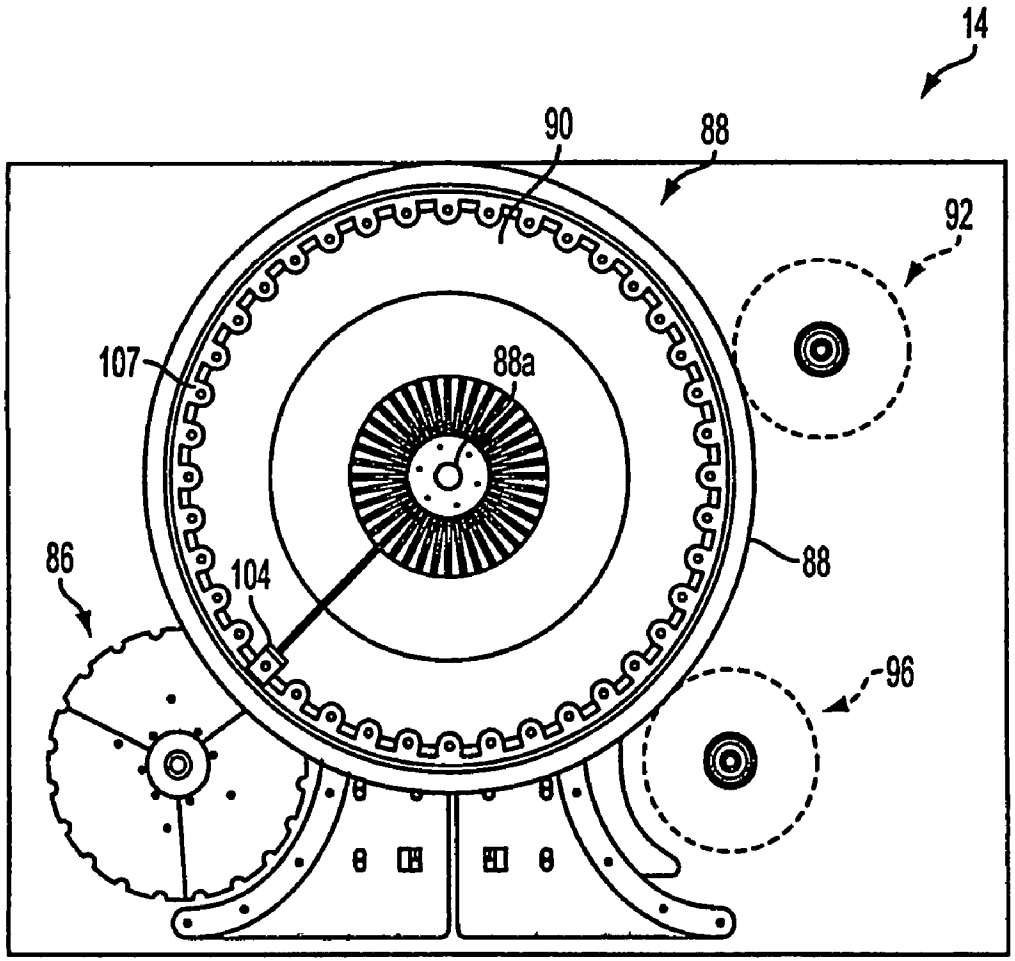
FIG. 11 is a detailed plan view of the activation portion of the handling system of FIG. 10.

Referring to FIGS. 10 and 11, one system for singularly activating containers C includes a feed-in scroll assembly 84, which feeds and, further, spaces the respective container holding devices and their containers at a spacing appropriate for feeding into a feed-in wheel 86. Feed-in wheel 86 is of similar construction to wheel 22*b* and includes a generally star-shaped wheel that feeds-in the container holders and containers to turret assembly 88. Turret assembly 88 is of similar construction to turret assembly 30 and includes a container holder wheel 90 for guiding and moving container holding devices H and containers C in a circular path and, further, a plurality of actuator assemblies 104 and 106 for removing the containers from the container holders and for activating the respective containers, as will be more fully described below. After the respective containers have been activated and the respective containers removed from the container holding devices, the holders are discharged by a discharge wheel 92 to conveyor 94 and the containers are discharged by a discharge wheel 96 to a conveyor 98 for further processing. Wheels 86, 92, and 96 may be driven by a common motor, which is drivingly coupled to gears or sheaves mounted to the respective shafts of wheels 86, 92, and 96.

As previously noted, turret assembly 88 is of similar construction to turret assembly 30 and includes container holder wheel 90, upper and lower cam assemblies 100 and 102, respectively, a plurality of actuator assemblies 104 for griping the containers, and a plurality of actuator assemblies 106 for activating the containers. In addition, turret system 88 includes a support plate 107, which supports the container holders and containers as they are moved by turret system 88. As best seen in FIG. 11, container holder wheel 90, actuator assemblies 104, actuator assemblies 106, and plate 107 are commonly mounted to shaft 88*a* so that they rotate in unison. Shaft 88*a* is similarly driven by the common motor, which is drivingly coupled to a gear or sheave mounted on shaft 88*a*.

Figure 12:
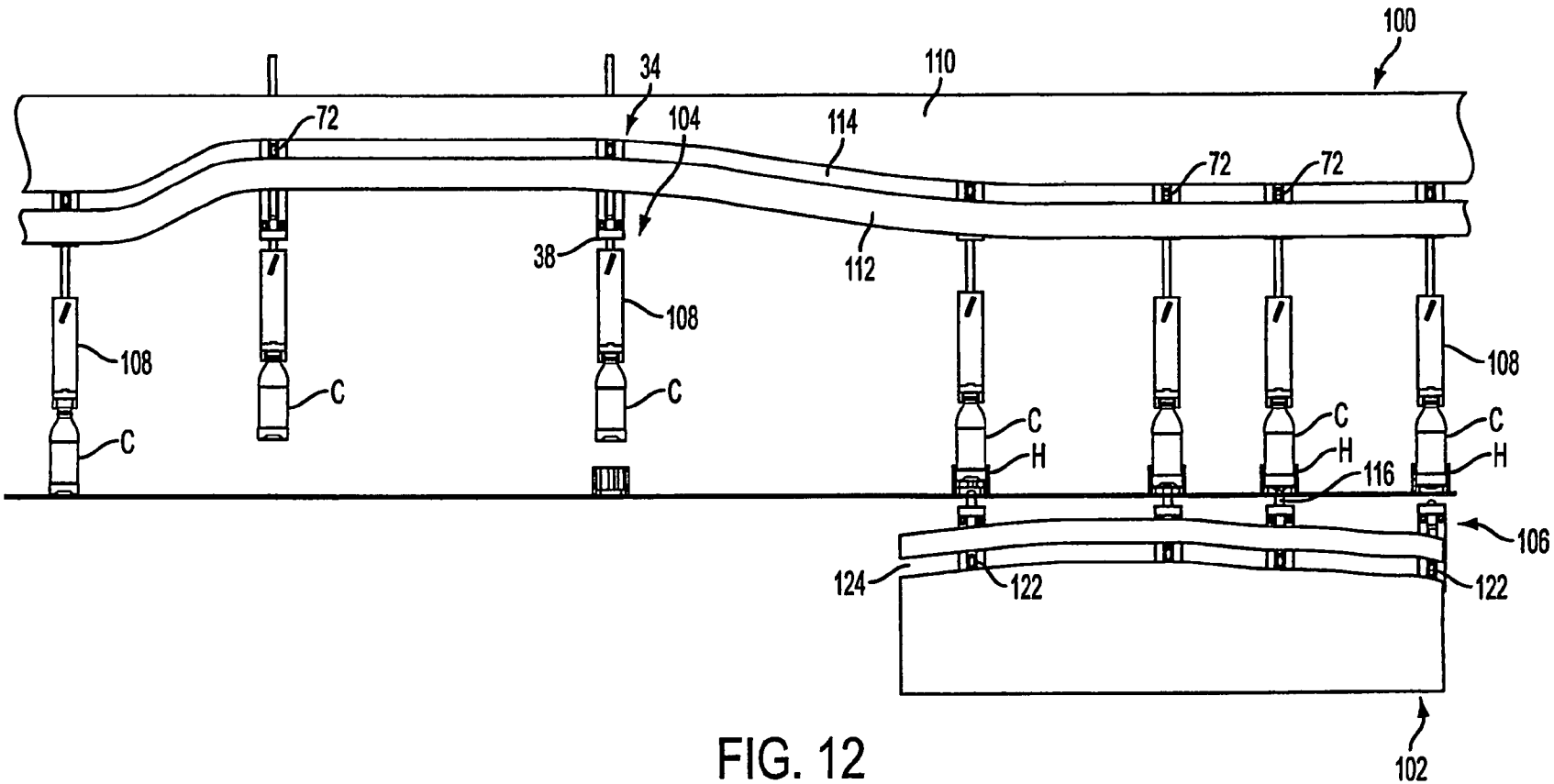
FIG. 12 is an unfolded elevation view of a section of the activation portion of FIG. 10 illustrating the activation of the container and the removal of the container from the container holding device.
Figure 13:
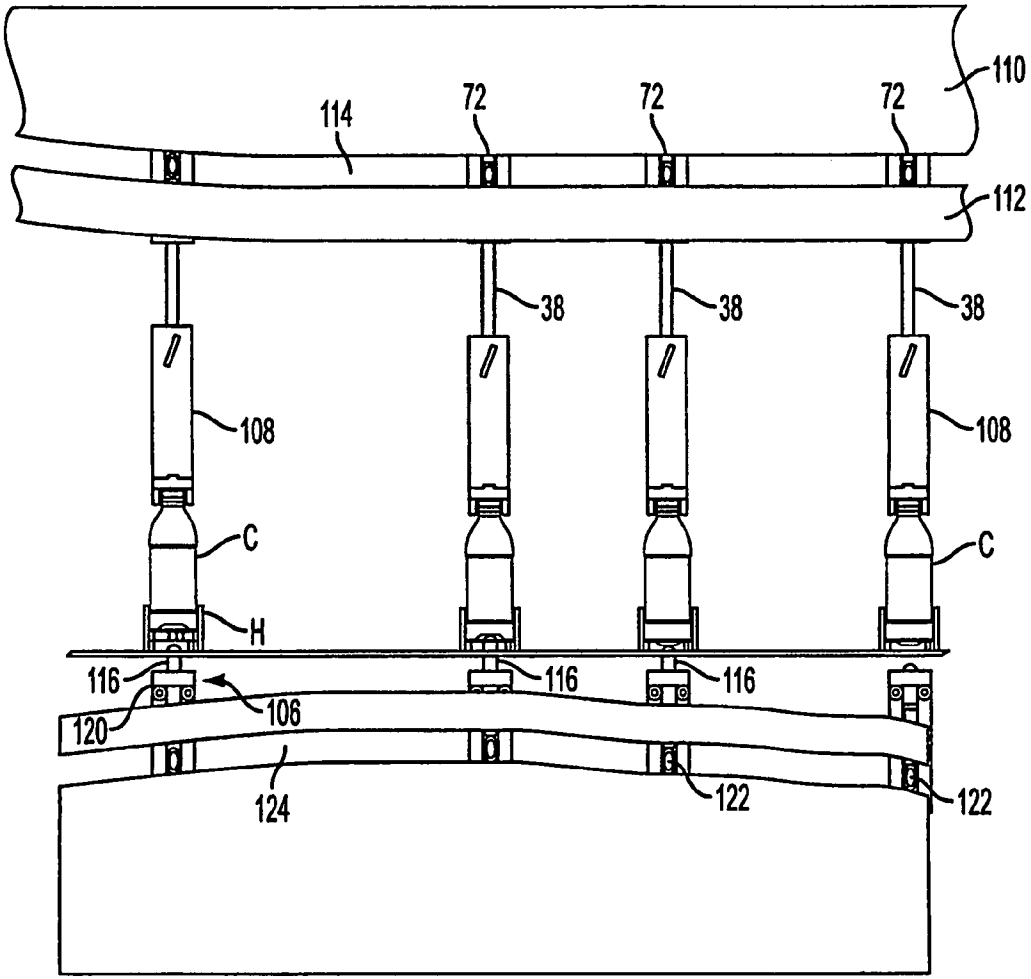
FIG. 13 is an enlarged view of a section of the activation portion of FIG. 12.
Figure 14:
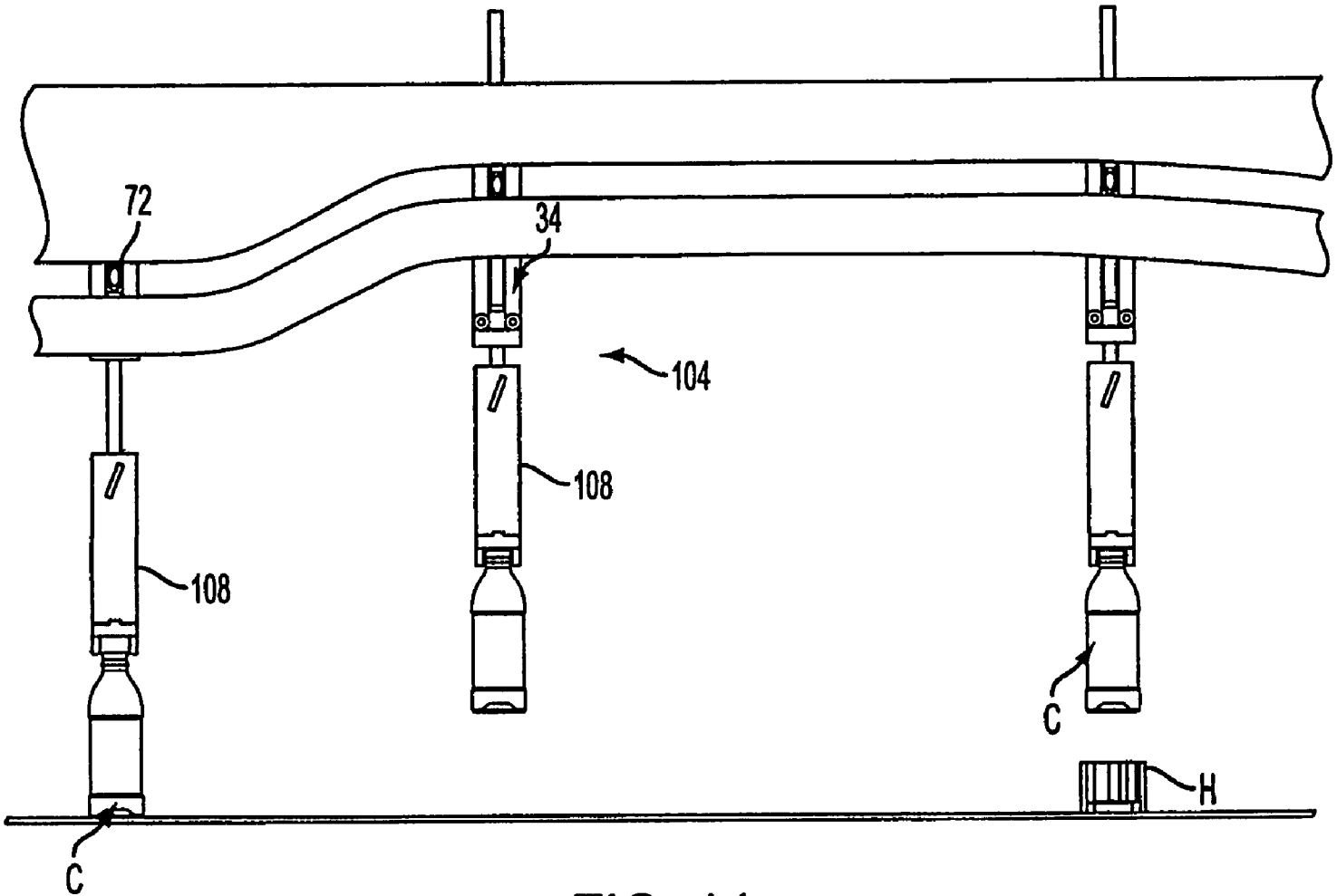
FIG. 14 is an enlarged view of the container holder removal section of FIG. 12.

Looking at FIGS. 12-14, actuator assemblies 104 and 106 are similarly controlled by upper and lower cam assemblies 100 and 102, to remove the containers C from the container holding devices H and activate the respective containers so that the containers generally assume their normal geometrically stable configuration wherein the containers can be supported from their bottom surfaces and be conveyed on a conventional conveyor. Referring to FIG. 12, each actuator assembly 104 includes actuator assembly 34 and a container gripper 108 that is mounted to the extendable rod 38 of actuator assembly 34. As would be understood, grippers 108 are, therefore, extended or retracted with the extension or retraction of extendable rods 38, which is controlled by upper cam assembly 100.

Similar to upper cam assembly 50, upper cam assembly 100 includes an upper plate 110 and a lower plate 112, which define therebetween a cam surface or recess 114, which guides guide members 72 of actuator assemblies 104 to thereby extend and retract extendable rods 38 and in turn to extend and retract container grippers 108. As the containers are conveyed through turret assembly 88, a respective gripper 108 is lowered onto a respective container by its respective extendable rod 38. Once the gripper is positioned on the respective container, actuator assemblies 106 are then actuated to extend their respective extendable rods 116, which extend through plate 107 and holders H, to apply a compressive force onto the invertible projections of the containers to move the projections to their recessed or retracted positions to thereby activate the containers. As would be understood, the upward force generated by extendable rod 116 is counteracted by the downward force of a gripper 108 on container C. After the activation of each container is complete, the container then can be removed from the holder by its respective gripper 108.

Referring to FIGS. 12-13, each actuator assembly 106 is of similar construction to actuator assemblies 34 and 36 and includes a housing 120, which supports extendable rod 116. Similar to the extendable rods of actuator assemblies 34 and 36, extendable rod 116 includes mounted thereto a guide 122, which engages the cam surface or recess 124 of lower cam assembly 102. In this manner, guide member 122 extends and retracts extendable rod 116 as it follows cam surface 124 through turret assembly 88. As noted previously, when extendable rod 116 is extended, it passes through the base of container holding device H to extend and contact the lower surface of container C and, further, to apply a force sufficient to compress or move the invertible projection its retracted position so that container C can again resume its geometrically stable configuration for normal handling or processing.

The physics of manipulating the activation panel P or extendable rod 116 is a calculated science recognizing 1) Headspace in a container; 2) Product density in a hot-filled container; 3) Thermal differences from the fill temperature through the cooler temperature through the ambient storage temperature and finally the refrigerated temperature; and 4) Water vapor transmission. By recognizing all of these factors, the size and travel of the activation panel P or extendable rod 116 is calculated so as to achieve predictable and repeatable results. With the vacuum removed from the hot-filled container, the container can be light-weighted because the need to add weight to resist a vacuum or to build vacuum panels is no longer necessary. Weight reduction of a container can be anticipated to be approximately 10%.

The embodiments illustrated and discussed in this specification are intended only to teach those skilled in the art the best way known to the inventors to make and use the invention. Nothing in this specification should be considered as limiting the scope of the present invention. All examples presented are representative and non-limiting. The above-described embodiments of the invention may be modified or varied, without departing from the invention, as appreciated by those skilled in the art in light of the above teachings. It is therefore to be understood that, within the scope of the claims and their equivalents, the invention may be practiced otherwise than as specifically described.

We claim:

1. A system for processing a pre-formed plastic container filled with a hot product, comprising:

hot filling means for filling a rigid container body of the pre-formed plastic container with the hot product in a production line, the rigid container body having a surface surrounding an interior of the rigid container body and having a projection extending from the rigid container body;

means for capping a neck of the filled rigid container body with a cap in the next operation of the production line;

means for transporting through the production line the pre-formed plastic container having the projection extending from the rigid container body;

means for supporting, during the transporting, the rigid container body having the projection extending from the rigid container body;

means for cooling the rigid container body of the pre-formed plastic container filled with the hot product; and means for pushing the projection extending from the cooled rigid container body into the interior of the rigid container body so that the resultant, filled and cooled rigid container body is relatively free of structural geometry over a substantial portion of the surface.

2. The system for processing a pre-formed plastic container according to claim 1, wherein, when the rigid container body is cooled by said means for cooling, the cooling produces a vacuum within the rigid container body, and substantially all of the vacuum is taken up by the pushing.

3. The system for processing a pre-formed plastic container according to claim 1, further comprising means for blow-molding a parison to form the rigid container body, where the rigid container body has the neck, a shoulder area, a base, and a smooth side surface surrounding the interior of the rigid container body, and the projection extends from the base of the rigid container body before the filling begins.

4. The system for processing a pre-formed plastic container according to claim 3, further comprising:

means for inverting the projection extending from the rigid container body into the interior of the rigid container body in the next operation of the production line after the parison is blow-molded; and means for repositioning the projection of the rigid container body with a force prior to the filling by said filling means for filling so that the projection moves outside of the rigid container body and extends from the rigid container body.

5. The system for processing a pre-formed plastic container according to claim 1, wherein the rigid container body with the projection extending from the rigid container body is conveyed by its neck during the filling and capping.

6. The system for processing a pre-formed plastic container according to claim 1, wherein the means for pushing the projection extending from the cooled rigid container body into the interior of the rigid container body is configured to position an actuator panel with projections extending therefrom underneath a container holding device where the projections of the actuator panel correspond with container body projections through a respective opening of the container holding device;

further comprising means for moving the actuator panel so that the actuator panel projections push against the container body projections thereby forcing the container body projections inside respective rigid container bodies.

7. The system for processing a pre-formed plastic container according to claim 1, wherein the rigid container body has a grip portion in addition to the substantial portion of the surface that is relatively free of structural geometry.

8. The system for processing a pre-formed plastic container according to claim 1, further comprising at least a mini vacuum panel, wherein the pushing of the projection takes up a majority of a resultant vacuum caused by the cooling, and the mini vacuum panel takes up the remainder of the vacuum.

9. The system for processing a pre-formed plastic container according to claim 1, wherein, during the transporting, said means for supporting does not support the plastic container by the projection.

10. The system for processing a pre-formed plastic container according to claim 1, wherein said means for supporting supports the rigid container body having the projection extending therefrom by a standing surface thereof, the standing surface being distinct from the projection.

11. The system for processing a pre-formed plastic container according to claim 10, wherein said means for supporting supports the rigid container body having the projection extending therefrom by the standing surface thereof prior to said means for pushing the projection into the interior of the rigid container body.

12. The system for processing a pre-formed plastic container according to claim 11, wherein the container body with the projection extending from the container body is conveyed by its neck during the filling and capping.

13. The system for processing a pre-formed plastic container according to claim 11, wherein the means for pushing the projection extending from the cooled container body into the interior of the container body is configured to position an actuator panel with projections extending therefrom underneath a container holding device where the projections of the actuator panel correspond with container body projections through a respective opening of the container holding device;

further comprising means for moving the actuator panel so that the actuator panel projections push against the container body projections thereby forcing the container body projections inside respective container bodies.

14. The system for processing a pre-formed plastic container according to claim 1, wherein, during the transporting a portion of the projection extends from the rigid container body below a standing ring.

15. A system for processing a pre-formed plastic container filled with a hot product, comprising:

hot filling means for filling a container body of the pre-formed plastic container with the hot product in a production line, the container body having a surface surrounding an interior of the container body and having a projection extending from the container body;

means for capping a neck of the filled container body with a cap in the next operation of the production line;

means for transporting through the production line the pre-formed plastic container having the projection extending from the container body;

means for supporting, during the transporting, the container body having the projection extending from the container body;

means for cooling the container body of the pre-formed plastic container filled with the hot product; and means for pushing the projection extending from the cooled container body into the interior of the container body so that the resultant, filled and cooled container body is relatively free of structural geometry over a substantial portion of the surface.

16. The system for processing a pre-formed plastic container according to claim 15, wherein, when the container body is cooled by said means for cooling, the cooling produces a vacuum within the container body, and substantially all of the vacuum is taken up by the pushing.

17. The system for processing a pre-formed plastic container according to claim 16, further comprising:

means for inverting the projection extending from the container body into the interior of the container body in the next operation of the production line after the parison is blow-molded; and means for repositioning the projection of the container body with a force prior to the filling by said filling means for filling so that the projection moves outside of the container body and extends from the container body.

18. The system for processing a pre-formed plastic container according to claim 15, further comprising means for blow-molding a parison to form the container body, where the container body has the neck, a shoulder area, a base, and a smooth side surface surrounding the interior of the container body, and the projection extends from the base of the container body before the filling begins.

19. The system for processing a pre-formed plastic container according to claim 15, wherein the container body has a grip portion in addition to the substantial portion of the surface that is relatively free of structural geometry.

20. The system for processing a pre-formed plastic container according to claim 15, further comprising at least a mini vacuum panel, wherein the pushing of the projection takes up a majority of a resultant vacuum caused by the cooling, and the mini vacuum panel takes up the remainder of the vacuum.

21. The system for processing a pre-formed plastic container according to claim 15, wherein, during the transporting, said means for supporting does not support the plastic container by the projection.

22. The system for processing a pre-formed plastic container according to claim 15, wherein said means for supporting supports the container body having the projection extending therefrom by a standing surface thereof, the standing surface being distinct from the projection.

23. The system for processing a pre-formed plastic container according to claim 22, wherein said means for supporting supports the container body having the projection extending therefrom by the standing surface thereof prior to said means for pushing the projection into the interior of the container body.

24. The system for processing a pre-formed plastic container according to claim 15, wherein, during the transporting a portion of the projection extends from the container body below a standing surface.

25. The system for processing a pre-formed plastic container according to claim 15, wherein the container body is rigid.

* * * * *

UNITED STATES PATENT AND TRADEMARK OFFICE

CERTIFICATE OF CORRECTION

PATENT NO. : 7,726,106 B2
APPLICATION NO. : 10/566294
DATED : June 1, 2010
INVENTOR(S) : Paul Kelley et al.

It is certified that error appears in the above-identified patent and that said Letters Patent is hereby corrected as shown below:

On the Title Page:

Insert --(73) Assignee: Graham Packaging Company, L.P., York, Pennsylvania 17402--

Signed and Sealed this
Eleventh Day of January, 2011

David J. Kappos

David J. Kappos
*Director of the United States Patent and Trademark Office*